US009247358B2

(12) United States Patent
Kristensen et al.

(10) Patent No.: US 9,247,358 B2
(45) Date of Patent: Jan. 26, 2016

(54) HEARING AID WITH SAFETY FEATURE FOR OPENING A BATTERY DOOR

(71) Applicant: GN ReSound A/S, Ballerup (DK)

(72) Inventors: Allan Møller Kristensen, Frederikssund (DK); Per Peterson, Rødovre (DK)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 13/852,844

(22) Filed: Mar. 28, 2013

(65) Prior Publication Data

US 2014/0270295 A1 Sep. 18, 2014

(30) Foreign Application Priority Data

Mar. 14, 2013 (DK) ..... 2013 70155

(51) Int. Cl.
*H04R 25/00* (2006.01)

(52) U.S. Cl.
CPC ..... *H04R 25/65* (2013.01); *H04R 25/602* (2013.01)

(58) Field of Classification Search
CPC .. H04R 25/60; H04R 25/602; H04R 2460/17; H04R 2225/77; H04R 2225/021; H04R 2225/63; H01M 2/1044; B65D 50/067
USPC ..... 381/330, 322, 323, 324
See application file for complete search history.

(56) References Cited

U.S. PATENT DOCUMENTS 5,386,476 A 1/1995 Bisgaard et al.
5,588,064 A * 12/1996 McSwiggen ..... H04R 25/602 381/312
2009/0042426 A1* 2/2009 Kramer ..... H04R 25/65 439/188
2010/0226519 A1* 9/2010 Spragge et al. ..... 381/323
2010/0260366 A1 10/2010 Heerlein et al.
2011/0261984 A1* 10/2011 Reber ..... H04R 25/602 381/323

FOREIGN PATENT DOCUMENTS

| | | | |
|---|---|---|---|
| DE | 10246439 | A1 | 4/2004 |
| DE | 10 2011 081 958 | A1 | 5/2012 |
| DE | 10 2012 204 185 | B3 | 1/2013 |
| EP | 0674465 | A1 | 12/1994 |
| EP | 0 674 465 | A1 | 9/1995 |
| EP | 1775993 | A1 | 4/2007 |
| EP | 2136574 | A2 | 12/2009 |
| WO | WO 2010/114485 | A1 | 10/2010 |

OTHER PUBLICATIONS

Extended European Search Report dated Jun. 16, 2014 for related EP Patent Application No. 13192951.5, 7 pages.
1st Technical Examination and Search Report dated Oct. 28, 2013 for DK Patent Application No. PA 2013 70155, 4 pages.

* cited by examiner

*Primary Examiner* — Davetta W Goins
*Assistant Examiner* — Jasmine Pritchard
(74) *Attorney, Agent, or Firm* — Vista IP Law Group, LLP

(57) ABSTRACT

A hearing aid includes: a housing having an exterior surface and an opening at the exterior surface; a battery door moveably coupled to the housing; and a spring element located in the housing, wherein the spring element is aligned with the opening of the housing to allow actuation of the spring element by a tool that is inserted through the opening of the housing; wherein when the spring element is actuated by the tool, the battery door is allowed to be fully opened, and when the spring element is un-actuated, the battery door is prevented from being fully opened.

16 Claims, 7 Drawing Sheets

HEARING AID WITH SAFETY FEATURE FOR OPENING A BATTERY DOOR

RELATED APPLICATION DATA

This application claims priority to and the benefit of Danish Patent Application No. PA 2013 70155, filed on Mar. 14, 2013, pending. The entire disclosure of the above-identified application is expressly incorporated by reference herein.

FIELD

An embodiment described herein relates to a hearing aid, and more particularly, to a hearing aid with a battery door.

BACKGROUND

Hearing aids have been used for compensating hearing loss of users. Sometimes, a hearing aid may have a battery door that can be easily opened to access the battery housed in the hearing aid. However, such hearing aid may not be suitable for use by infants or children. This is because a child may easily open the battery door and gain access to the battery. As batteries for hearing aids can be quite small, they may become choking hazard for the young users. Thus, it may be desirable to have a safety feature in a hearing aid to prevent a user, such as an infant or a young child, from gaining access to the battery in the hearing aid.

SUMMARY

A hearing aid includes: a housing having an exterior surface and an opening at the exterior surface; a battery door moveably coupled to the housing; and a spring element located in the housing, wherein the spring element is aligned with the opening of the housing to allow actuation of the spring element by a tool that is inserted through the opening of the housing; wherein when the spring element is actuated by the tool, the battery door is allowed to be fully opened, and when the spring element is un-actuated, the battery door is prevented from being fully opened.

Optionally, the hearing aid may further include a battery holder, wherein the battery door is a part of the battery holder.

Optionally, wherein at least a part of the spring element may be moveable relative to the housing in response to actuation by the tool.

Optionally, the spring element may be coupled to the battery door, and may be moveable together with the battery door.

Optionally, the spring element may comprise a portion for abutment against a part of the housing to prevent the battery door from being fully opened when the battery door is moved to a partially-opened position.

Optionally, the portion of the spring element may be configured to move relative to the housing to an actuated position in response to actuation of the spring element by the tool inserted through the opening of the housing, wherein when the portion of the spring element is at the actuated position, the portion of the spring element is out of abutment with the part of the housing, and the battery door is allowed to be moved to a fully-opened position.

Optionally, the spring element may be coupled to the battery door and may be moveable together with the battery door.

Optionally, the spring element may be spaced away from the part of the housing by a distance when the battery door is fully closed to allow the battery door to be partially opened before the spring element engages with the part of the housing.

Optionally, the spring element may comprise a portion for abutment against a part of the housing to prevent the battery door from being partially opened.

Optionally, the portion of the spring element may be configured to move relative to the housing to an actuated position in response to actuation of the spring element by the tool inserted through the opening of the housing, wherein when the portion of the spring element is at the actuated position, the portion of the spring is out of abutment with the part of the housing, and the battery door is allowed to be moved to an opened position.

Optionally, the spring element may be coupled to the battery door and may be moveable together with the battery door.

Optionally, the spring element may be engaged with the part of the housing when the battery door is fully closed, to prevent the battery door from being partially opened.

Optionally, the spring element may be moveably coupled to the housing.

Optionally, the spring element may comprise a lever that is rotatably coupled to the housing.

Optionally, the battery door may comprise an engagement portion.

Optionally, the spring element may be configured to engage the engagement portion of the battery door to prevent the battery door from being fully opened.

Optionally, the spring element may be spaced away from the engagement portion of the battery door when the battery door is fully closed relative to the housing, and wherein the battery door is moveable relative to the housing by a distance to a partially opened position, at which position, the spring element engages with the engagement portion of the battery door to prevent the battery door from being further moved relative to the housing.

Optionally, the spring element may be engaged with the engagement portion of the battery door when the battery door is fully closed relative to the housing to prevent the battery door from being partially opened.

Optionally, the battery door may be in a form of a battery holder.

Optionally, the hearing aid may further include a sound tube coupled to the housing.

Optionally, the housing may be a part of a behind-the-ear unit.

Other and further aspects and features will be evident from reading the following detailed description.

BRIEF DESCRIPTION OF THE DRAWINGS

The drawings illustrate the design and utility of various features described herein, in which similar elements are referred to by common reference numerals. These drawings are not necessarily drawn to scale. In order to better appreciate how the above-recited and other advantages and objects are obtained, a more particular description will be rendered, which are illustrated in the accompanying drawings. These drawings depict only exemplary features and are not therefore to be considered limiting in the scope of the claims.

DETAILED DESCRIPTION

Figure 1:
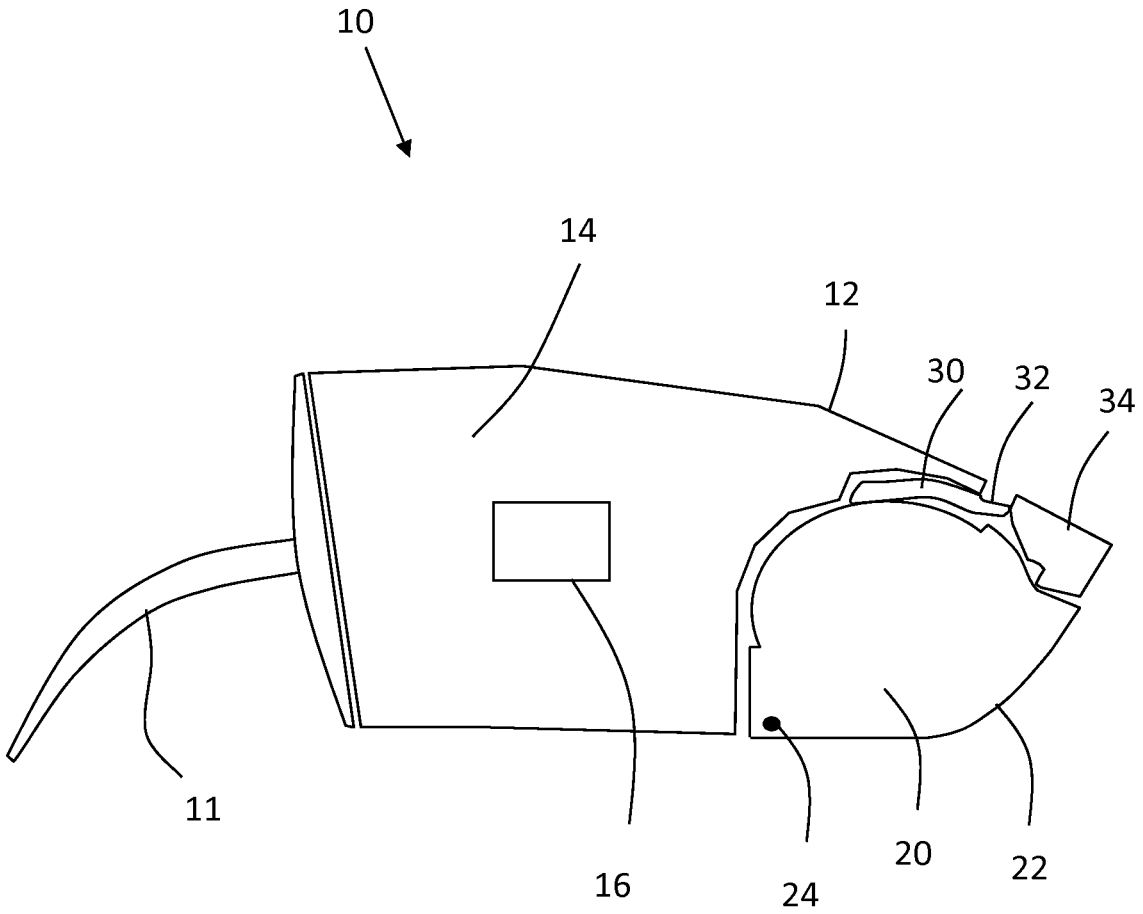
FIG. 1 illustrates a component of a hearing device.

Various features are described hereinafter with reference to the figures. It should be noted that the figures are not drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated.

FIG. 1 illustrates a component 10 of a hearing aid in accordance with some embodiments. In the illustrated embodiments, the component 10 is a behind-the-ear (BTE) unit of the hearing aid, and is coupled to a sound tube 11. In some cases, the sound tube 11 may be considered to be a part of the component 10. In some cases, the sound tube 11 comprises a hollow tube that is configured to transmit acoustic sound signal. In other cases, the sound tube 11 may include an electrical conductor that is configured to transmit sound signal in electrical form. The sound signal is transmitted via the sound tube 11 to an earpiece that is connected to the sound tube 11, wherein the earpiece is configured for placement in the ear.

As shown in the figure, the component 10 includes a housing 12 defining a cavity 14 for accommodation of one or more electronic component(s) 16 of the hearing aid. The component 10 also includes a battery door 20 having a wall 22 for covering a battery placed inside, or held by, the battery door 20. In some cases, the wall 22 of the battery door 20 may be considered a battery door. As used in this specification, the term "battery door" may refer to any component, such as a cover, a wall, or any structure that covers part or all of a battery. Thus, the term "battery door" is not limited to a door-like component, and may refer to any portion of the hearing aid that is moveable relative to the housing 12. In the illustrated embodiments, the battery door 20 has a form of a battery holder, or may be considered as a part of a battery holder, for holding a battery, so that when the battery door 20 is opened, the battery will be moved at least partially out of the housing 12 together with the battery door 20. In other embodiments, the battery may stay inside the housing 12 and not be moved with the battery door 20. The battery door 20 is rotatably coupled to the housing 12 via a hinge 24. In other embodiments, the battery door 20 may be translatable (e.g., in a rectilinear path or a curvilinear path) relative to the housing 12.

As shown in the figure, the component 10 also includes a spring element 30 located within the housing 12. The spring element 30 is aligned with an opening 32 located at an exterior surface 34 of the housing 12. As such, the spring element 30 may be actuated by a tool that is inserted into the opening 32 of the housing 12.

Figure 2:
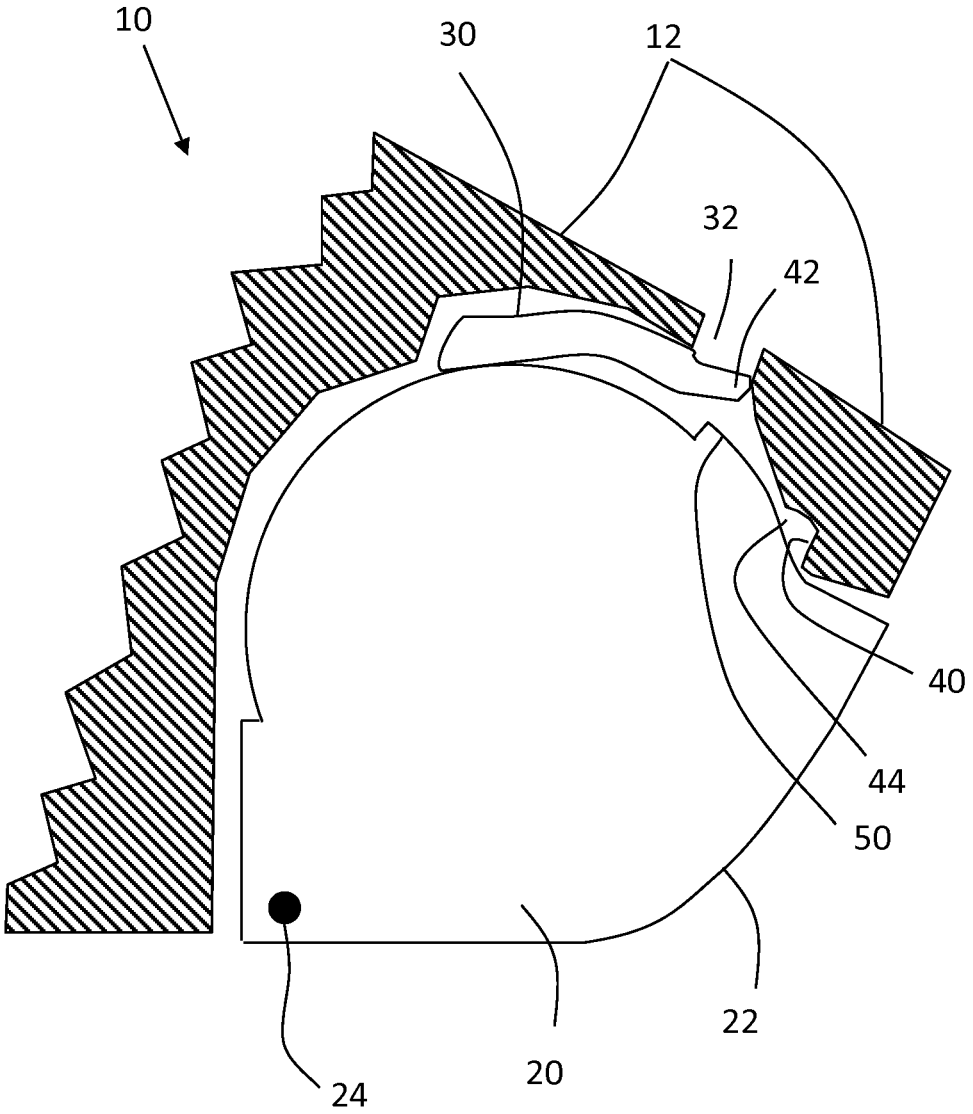
FIG. 2 is an exploded view of the component of the hearing device of FIG. 1.

FIG. 2 illustrates the component 10 of FIG. 1 in further detail. As shown in FIG. 2, the spring element 30 is coupled to the battery door 20 so that movement of the battery door 20 will also move the spring element 30 together with the battery door 20. For example, the spring element 30 may be mechanically connected to the battery door 20, such as, via an adhesive, screw, or any of other types of connector. Alternatively, the spring element 30 and the battery door 20 may be integrally formed together to have an unity configuration. The housing 12 also includes a portion/part 40 configured to engage with an end 42 of the spring element 30 when the battery door 20 together with the spring element 30 is rotated to a partially opened position. The portion/part 40 may optionally include a lock recess 44 sized and shaped to mate with the end 42 of the spring element 30. When the battery door 20 is fully closed, terminals of the battery in the battery door 20 are in contact with the terminal wires from the hearing aid, and power from the battery can be supplied to the hearing aid circuitry.

Also, in the illustrated embodiments, the battery door 20 also includes a support portion 50 for preventing the spring element 30 from being actuated past a certain position, thereby preventing damage to the spring element 30 that may otherwise result when there is no battery in place, and the spring element 30 would otherwise be allowed to hyperextend into the battery cavity. Thus, the support portion 50 is configured to prevent the spring element 30 from being pushed into the battery cavity.

Figure 3:
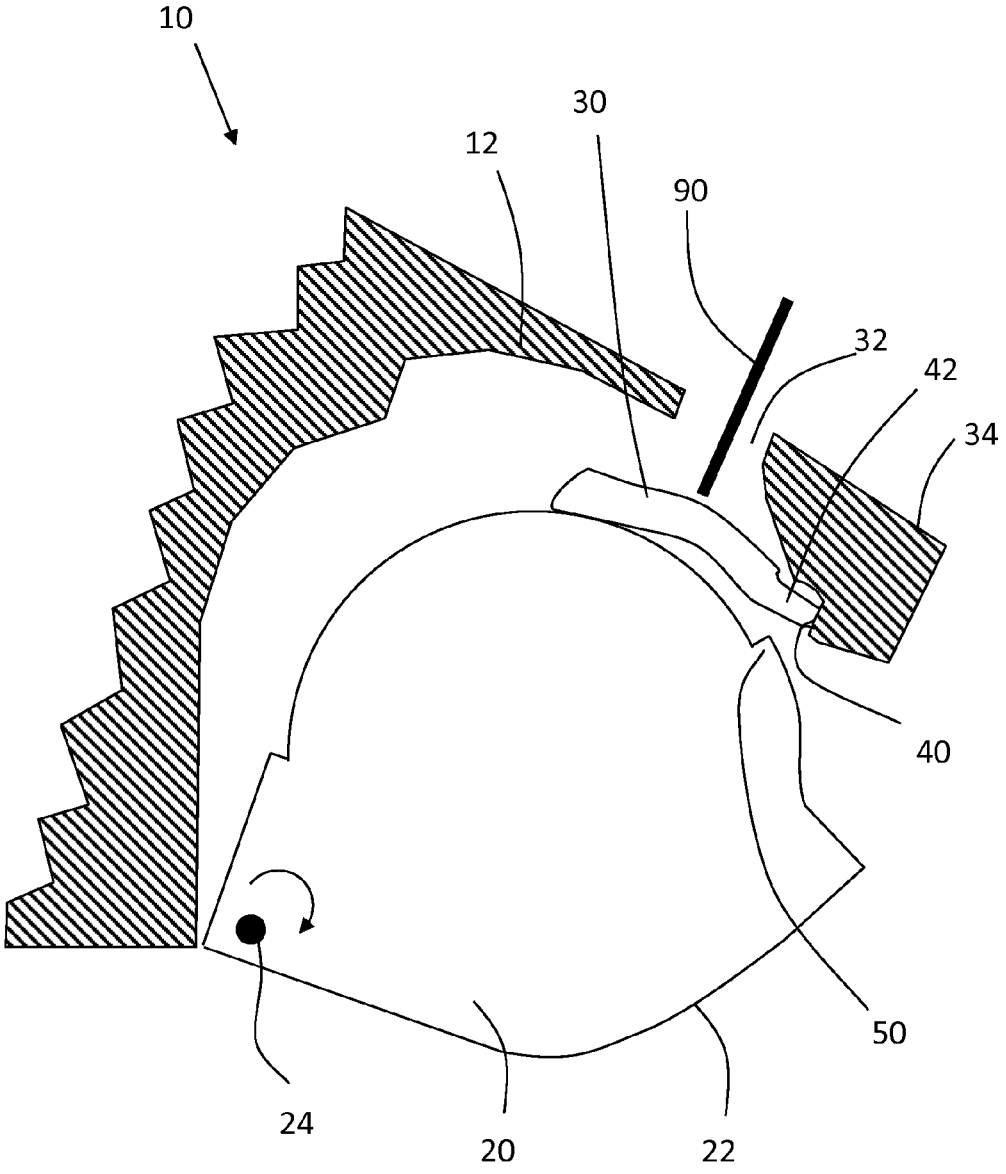
FIGS. 3-5 illustrate a method of using the component of the hearing device of FIG. 1.
Figure 4:
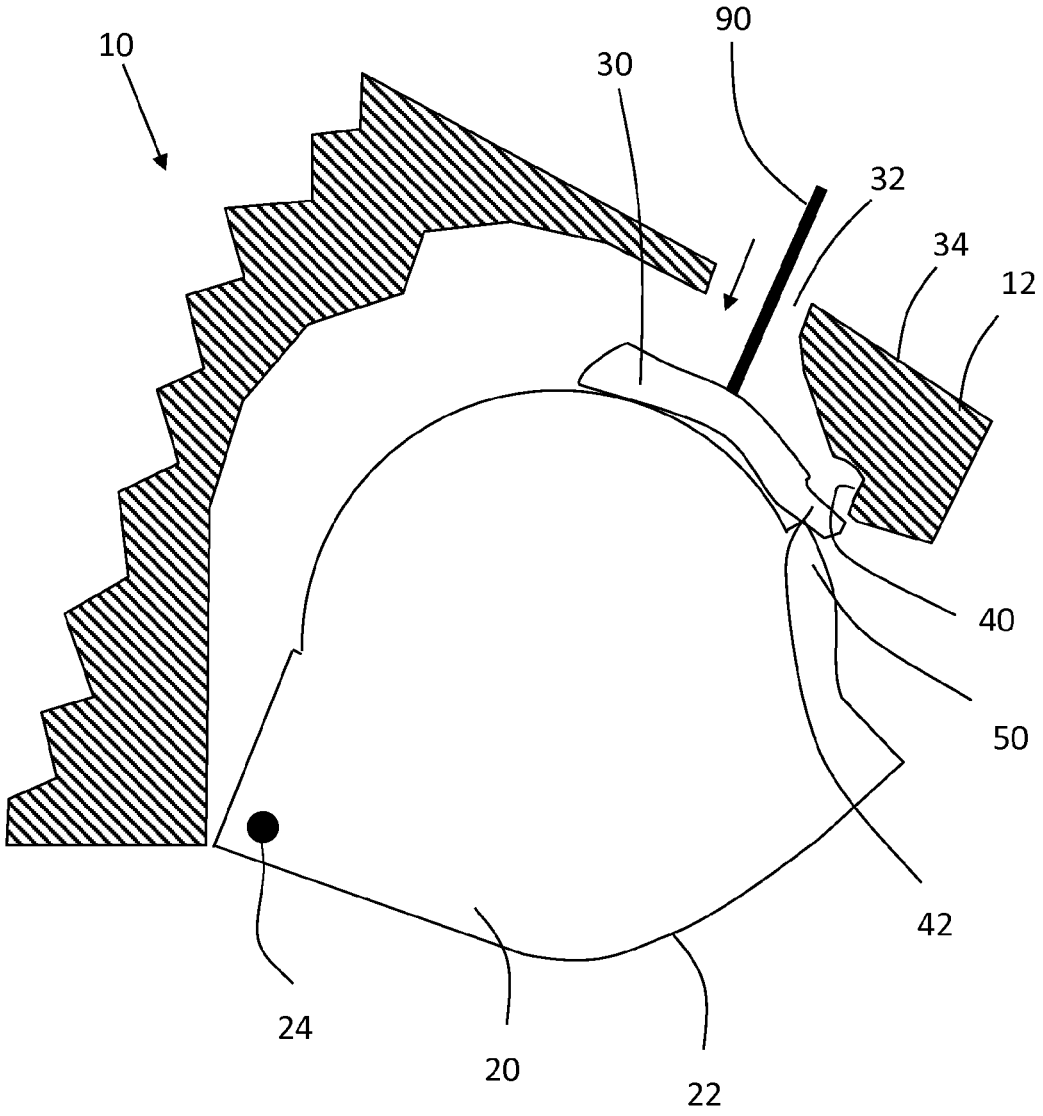
Figure 5:
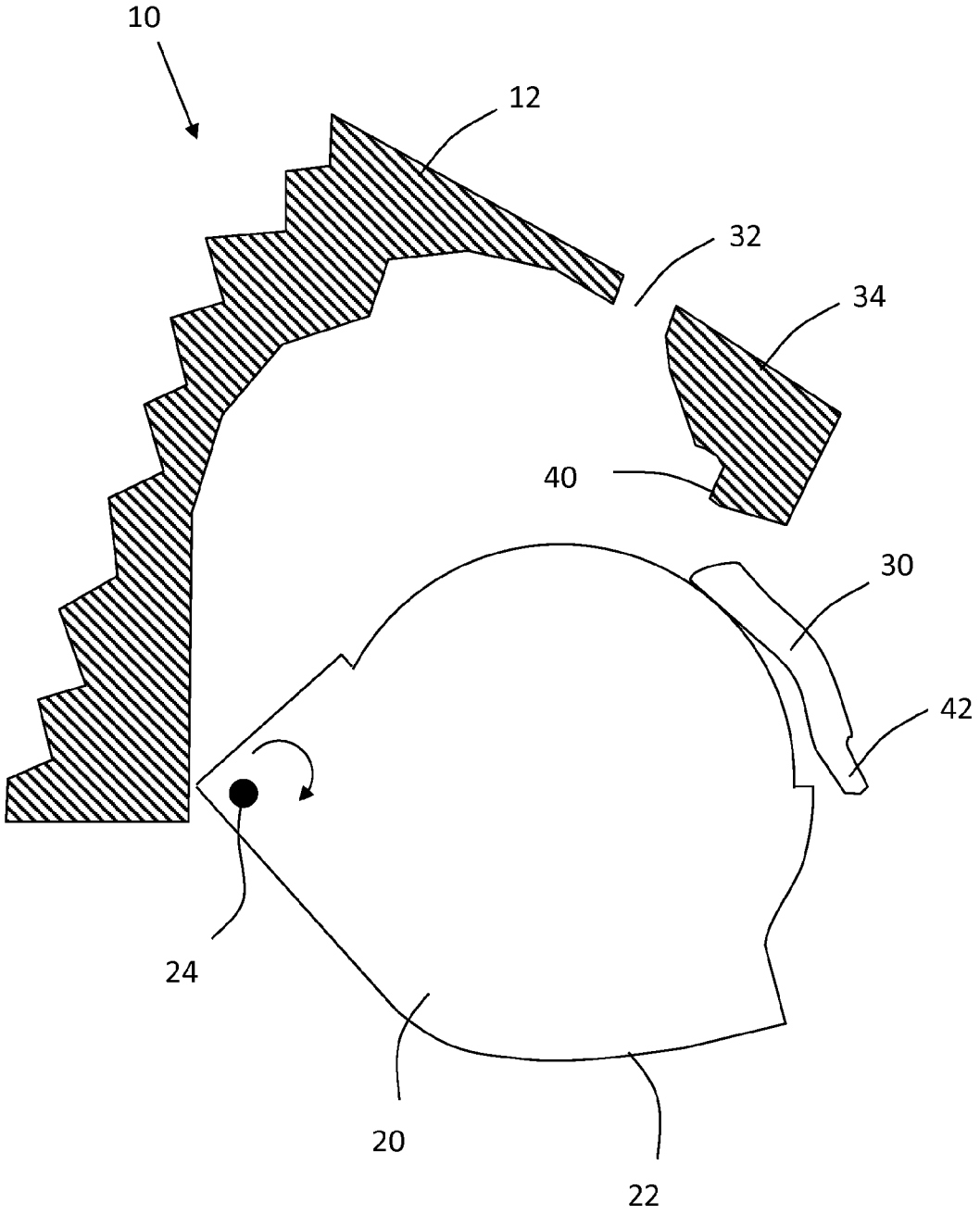

FIGS. 3-5 illustrate a method of using the component 10 of FIG. 1 in accordance with some embodiments. As shown in FIG. 3, a user may wish to open the battery door 20 by rotating the battery door 20 relative to the housing 12 about the hinge 24. Because the end 42 of the spring element 30 is spaced away from the portion/part 40 of the housing 12, the battery door 20 is allowed to be partially opened to a partially opened position. At the partially opened position, the end 42 of the spring element 30 is engaged with the portion/part 40 of the housing 12, thereby preventing the battery door 20 from being further moved to a fully opened position. This feature is advantageous because sometimes the user of the hearing device may be an infant or a child, who may open the battery door 20 and accidentally swallow the hearing aid battery. The configuration of the component 10 prevents the battery door 20 from being fully opened, and as a result an infant or a child would not be able to take out the battery housed in the battery door 20. Also, allowing the battery door 20 to be partially opened is advantageous because it allows a person to determine whether there is a battery inside or not. When the battery door 20 is moved to the partially opened position shown in the figure, there is no contact between a battery terminal and circuitry of the hearing aid. This means that power from battery to the hearing aid circuitry cannot be supplied.

As shown in FIGS. 3 and 4, in order to fully open the battery door 20, a tool 90 is required to be inserted into the opening 32 of the housing 12 to reach the spring element 30. In some cases, the tool 90 may be provided as an accessory for the hearing aid. The tool 90 may be used to actuate (e.g., by pressing) the spring element 30 to flex the spring element 30 (i.e., into a stressed state). In particular, as shown in FIG. 4, the spring element 30 is actuated by using the tool 90 to exert pressure towards an interior of the housing 12 (e.g., moving the tool 90 from the outside towards the inside of the housing 12). When the spring element 30 is actuated, the end 42 of the spring element 30 is moved out of engagement/abutment with the portion/part 40 of the housing 12, like that shown in FIG. 4. As shown in the figure, the support portion 50 at the battery door 20 prevents the spring element 30 from being pressed further when the spring element 30 has been actuated to the actuated position. As shown in FIG. 4, the portion (e.g., end 42) of the spring element 30 is configured to move relative to the housing 12 to an actuated position in response to actuation of the spring element by the tool 90 inserted through the opening 32 of the housing 12. When the spring element 30 is at the actuated position, the end 42 of the spring element 30 no longer engaged (out of abutment) with the portion/part 40 of the housing 12, and the battery door 20 together with the spring element 30 are allowed to further move (e.g., rotate) relative to the housing 12 to a fully opened position (FIG. 5).

As shown in FIG. 5 when the battery door 20 is fully opened, the spring element 30 is outside the housing 12. In other embodiments, the spring element 30 may remain inside the housing 12 even when the battery door 20 is fully opened. For example, in other embodiments, the spring element 30 may be located closer to the hinge 24 so that when the battery door is fully opened, the spring element 30 may remain at least partially inside the housing 12. Thus, as used in this specification, the phrase "a spring element located in the housing" may refer to a spring element that is always located in the housing regardless of whether the battery door 20 is opened or closed, or a spring element that is located in the housing when the battery door 20 is closed.

In some embodiments, the opening 32 may be a very small opening that is sized to accommodate a pin. In such cases, the tool 90 may be a pin. In other embodiments, the tool 90 may be a toothpick, a paper clip, a nail, a screw, etc. In such cases, the opening 32 may be sized according to the intended tool 90 to be used to open the battery door 20. In some embodiments, the opening 32 has a circular shape. It should be noted that the opening 32 is not limited to have a circular shape, and may have other shapes in other embodiments. For example, in other embodiments, the opening 32 may have a square shape, a rectangular shape, a cross shape (e.g., for accommodating a cross screw driver), a triangular shape, an oval shape, a pentagon shape, a hexagon shape, or a customized shape. In some cases, a rectangular shape of the opening 32 may allow a coin, a flat-head screw driver, a corner of a credit card, etc., to be used as the tool 90.

In other embodiments, instead of allowing the battery door 20 to be partially opened before the spring element 30 engages with the housing 12, the component 10 may be configured so that the battery door 20 is prevented by the spring element 30 to be partially opened when the battery door 20 is in the closed position. For example, in other embodiments, the spring element 30 may include a portion (e.g., the end 42) for abutment against the part 40 of the housing 12 when the battery door 20 is in the closed position, to prevent the battery door 20 from being partially opened. During use, the portion 42 of the spring element 30 is configured to move relative to the housing 12 to an actuated position in response to actuation of the spring element 30 by the tool 90 inserted through the opening 32 of the housing 12. When the portion 42 of the spring element 30 is at the actuated position, the portion 42 of the spring element 30 is out of abutment with the part 40 of the housing 12, and the battery door 20 is allowed to be moved to an opened position (e.g., a partially opened position, and then to a fully opened position).

In the above embodiments, the spring element 30 has been illustrated as having an elongated configuration (e.g., a lever, a finger, an arm, a rod, an elongated resilient member). The elongated spring element 30 may be a cantilever spring having a fixed end, and an opposite free end like that shown in the figure. In other embodiments, the spring element 30 may be supported at any location between two opposite ends. In other embodiments, the spring element 30 may have other configurations. For example, in other embodiments, the spring element may be in a form of a coil, a plate, a triangular anchor, or any of other shapes.

Also, in some embodiments, the spring element 30 may be more elastic (e.g., easily pressed) than the battery door 20. For example, in some embodiments, the spring element 30 may be made with a material that is more elastic than a material of the battery door 20. In other embodiments, the spring element 30 may be made from a material that is stiffer than a material of the battery door 20, but is still more elastic than the battery door 20. For example, the battery door 20 may be made from a polymer, and the spring element 30 may be a metallic coil that is configured to be more easily pressed than the battery door 20. In further embodiments, the spring element 30 may be made from the same material as that of the battery door 20 (e.g., the spring element 30 and the battery door 20 may be formed together using a same material, as in a molding technique), but the spring element 30 may have a form (e.g., a shape) that allows the spring element 30 to be more easily pressed than the battery door 20. For example, the spring element 30 may be molded to have a cantilever configuration, while the rest of the battery door 20 has a cup-like configuration, so that the spring element 30 is more elastic than the battery door 20.

Figure 6:
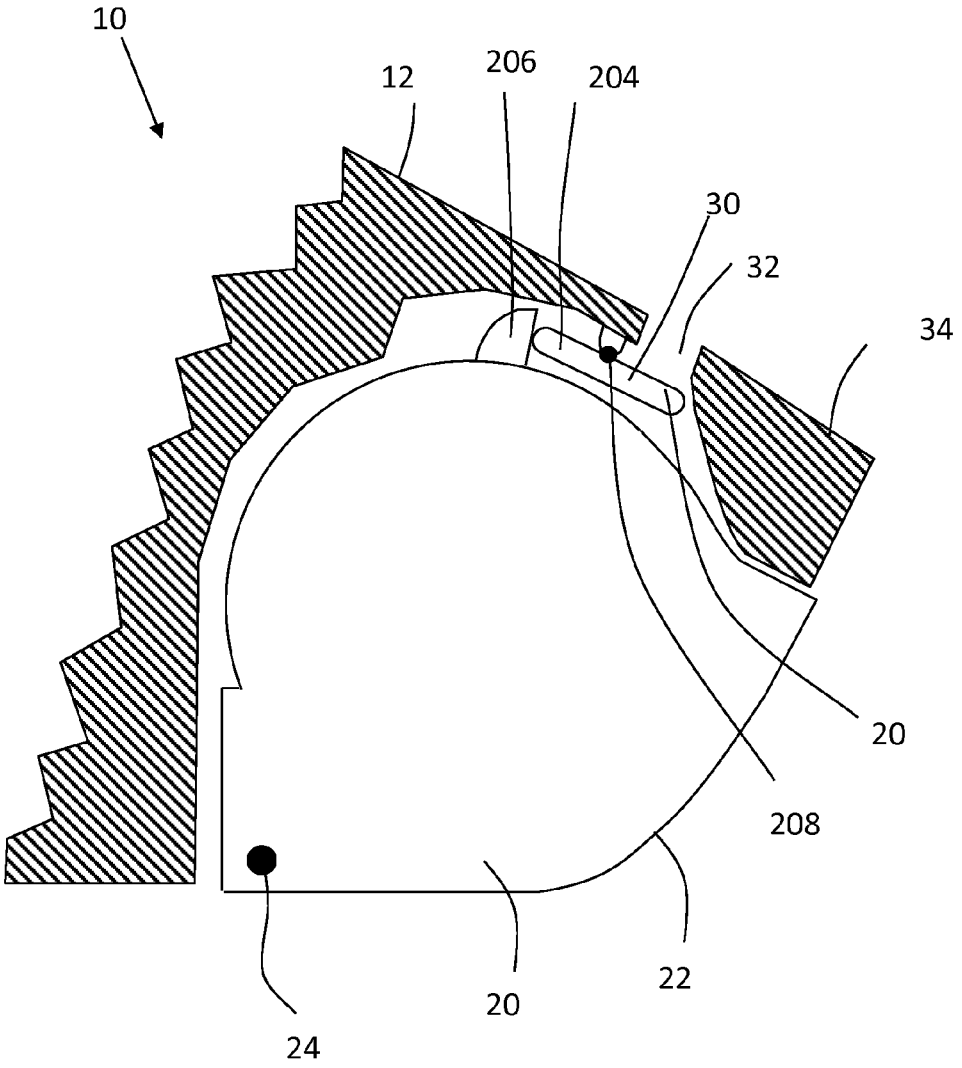
FIG. 6 illustrates another component of a hearing device, showing the component having a battery door in a closed configuration.

Also, in the above embodiments, the spring element 30 has been described as being coupled to the battery door 20. In other embodiments, the spring element 30 may be coupled to the housing 12. For example, FIG. 6 illustrates another embodiment of a component 10 of a hearing aid in which the spring element 30 is coupled to the housing 12. The spring element 30 may be mechanically attached to the housing 12, e.g., via an adhesive, a screw, a hinge, or any other types of connector. Alternatively, the spring element 30 may be formed integrally together with a part of the housing 12 to achieve an unity configuration with the housing 12. In the illustrated embodiments, the spring element 30 has a first end 202 for allowing a tool 90 (shown in FIG. 7) to engage thereto. The spring element 30 also has a second end 204 for engagement with an engagement portion 206 at the battery door 20. The spring element 30 is rotatably coupled to the housing 12 at a location 208, which may include a joint (e.g., that may be fixedly connected to the spring element 30), a rotation connection (e.g., a hinge), etc. The spring action of the spring element 30 may be accomplished by the joint, which is flexed in response to movement of the spring element 30. Alternatively, if a rotation connection is used, such connection may include a spring for providing the spring action for the spring element 30.

As shown in the figure, the spring element 30 is engaged with the engagement portion 206 of the battery door 20 when the battery door 20 is fully closed relative to the housing 12 to prevent the battery door 20 from being partially opened. Alternatively, the engagement portion 206 may be shifted to the left, and/or the spring element 30 may be shifted to the right, to thereby create a spacing between the engagement portion 206 and the end 204 of the spring element 30. Such configuration allows the battery door 20 to be partially until the engagement portion 206 engages with the end 204 of the spring element 30. The engagement between the end 204 of the spring element 30 and the engagement portion 206 then prevents the battery door 20 from being fully opened.

Figure 7:
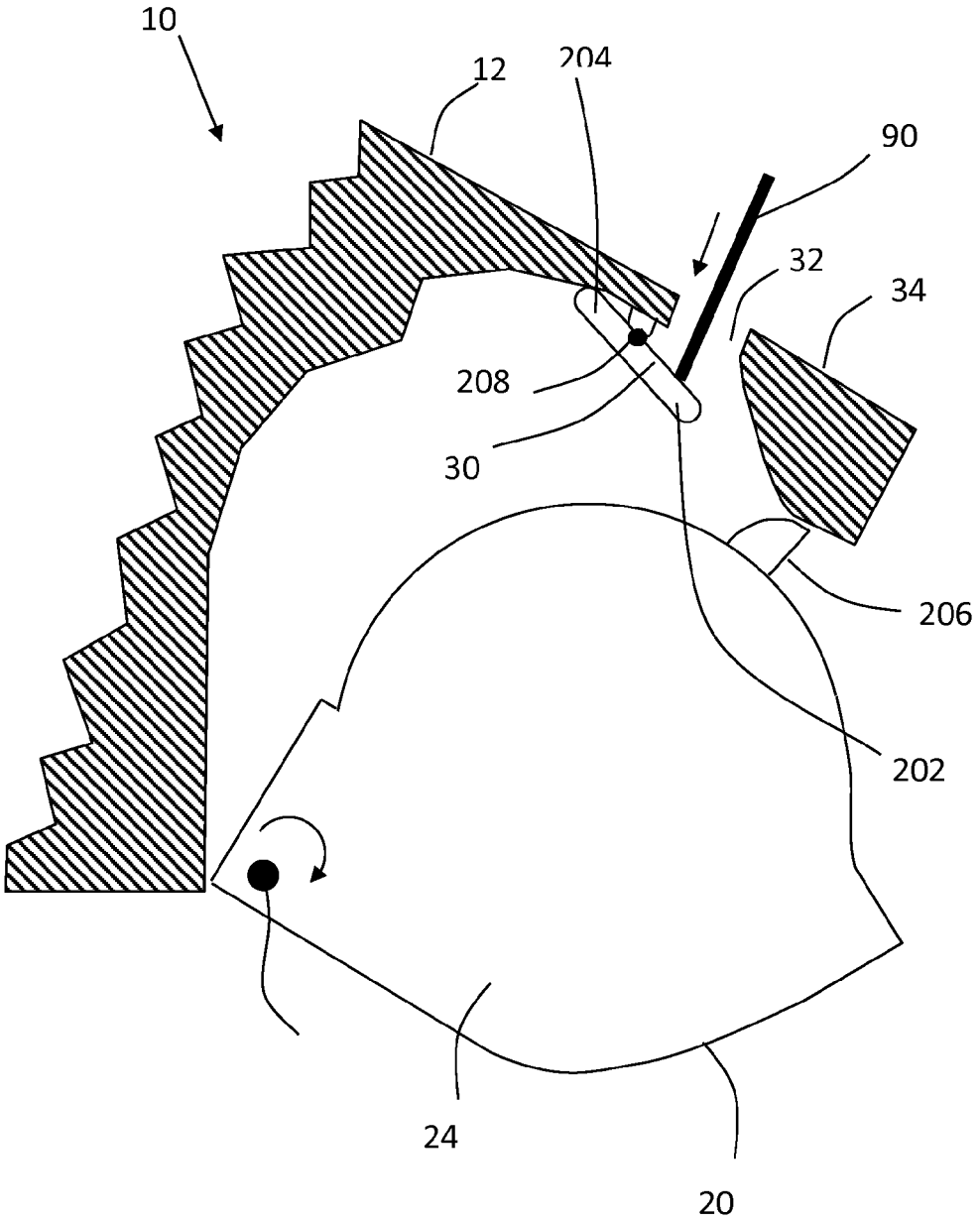
FIG. 7 illustrates the component of FIG. 6, showing the battery door in a fully opened configuration.

During use, as shown in FIG. 7, if it is desired to fully open the battery door 20 relative to the housing 12, a tool 90 may be inserted through the opening 32 at the exterior surface 34 of the housing 12 to engage with the first end 202 of the spring element 30. The tool 90 may be used to press the spring element 303 to rotate the spring element 303 about the location 208 to thereby actuate the spring element 303. When the spring element 303 rotates about location 208 in response to the pressing of the tool 90 against the spring element 303, the second end 204 of the spring element 303 moves out of abutment with the engagement portion 206. This allows the engagement portion 206 to move past the spring element 30 while the battery door 20 is rotated to the fully opened position.

In the embodiments of FIGS. 6 and 7, the spring element 30 has been illustrated as having an elongated configuration (e.g., a lever, a finger, an arm, a rod, an elongated resilient member). In other embodiments, the spring element 30 may have other configurations. For example, in other embodiments, the spring element may be in a form of a coil, a plate, a triangular anchor, or any of other shapes.

Also, in the embodiments of FIGS. 6 and 7, the opening 32 may be a very small opening that is sized to accommodate a pin. In such cases, the tool 90 may be the pin. In other embodiments, the tool 90 may be a toothpick, a paper clip, a nail, a screw, etc. In such cases, the opening 32 may be sized according to the intended tool 90 to be used to open the battery door 20. In some embodiments, the opening 32 may have a circular shape. It should be noted that the opening 32 is not limited to have a circular shape, and may have other shapes in other embodiments. For example, in other embodiments, the opening 32 may have a square shape, a rectangular shape, a cross shape (e.g., for accommodating a cross screw driver), a triangular shape, an oval shape, a pentagon shape, a hexagon shape, or a customized shape. In some cases, a rectangular shape of the opening 32 may allow a coin, a flat-head screw driver, a corner of a credit card, etc., to be used as the tool 90.

In the above embodiments, the component 10 has been described as having a battery door 20 that holds a battery which is moveable together with the battery door 12 relative to the housing 12. In some embodiments, the battery door 20 may have one or more side wall(s) defining a cavity for holding a battery. In other embodiments, the battery door 20 may include a clamp element that grasp the battery using frictional force. In further embodiments, the battery may be housed in the battery door 20 in a loose-fit configuration, so that when the component 10 is turned up-side down, the battery would fall out of the battery door 20. In other embodiments, the battery door 20 may be just a cover without any ability to hold a battery. In such cases, the housing 12 may include a cavity for housing a battery, which remains inside the housing 12 when the battery door 22 is moved relative to the housing 12. The spring element 30 may be coupled to the battery door 22 or to the housing 12 to prevent the battery door 22 from being partially opened or fully opened. When the tool 90 is inserted into the opening 32 to actuate the spring element 30, the battery door 22 is then allowed to move to a fully opened position.

In the above embodiments, the component 10 has been described as a BTE unit. Thus, the component 10 is a part of a BTE hearing aid. In other embodiments, the component 10 may be a part of other types of hearing aid. For example, in other embodiments, the component 10 may be a part of an in-the-canal hearing aid. For example, in other embodiments, the component 10 may be an earpiece that is configured to be inserted into an ear canal (e.g., partially into the ear canal, or completely in the ear canal) of the user of the hearing aid. In such cases, the component 10 may be sized and shaped for insertion at least partially into the ear canal. The housing 12 may be manufactured in a plurality of standard (predetermined) sizes for allowing a user to select from. Alternatively, the housing 12 may be customized to have certain size and shape that fits into an ear canal for a specific user. Also, in the embodiments in which the component 10 is an ear piece, the component 10 may not include the sound tube 11.

In addition, optionally, the component 10 may include an elongated member having one end attached to the housing 12 or to the battery door 20, and a free end. The elongated member is configured to apply a force to push the housing 12 against an anatomical feature in the ear of the user to thereby secure the hearing aid relative to the ear of the user. For example, in some cases, the elongated member may be configured to abut a part of a concha at an antitragus when the housing 12 has been inserted in the ear canal, thereby applying a force to the housing 12 towards the ear canal for retaining the housing 12 in a position in which the housing is pressed against an anatomical feature within the ear canal. In some embodiments, the elongated member is configured to be placed in a pinna and outside the ear canal of the user. Also, in some embodiments, the elongated member may be configured to abut an antihelix and extends at least to an inferior crus of the antihelix during use. In some cases, the free end of the elongated member may be located below a triangular fossa of the user during use. The elongate member may be flexible and preformed in some embodiments. Also, in some embodiments, the elongated member may be substantially rigid in its longitudinal direction. Optionally, in some cases, the elongated member may be configured (e.g., sized and/or shaped) for accommodation of a microphone. In some cases, a part of the elongated member at the free end for accommodation of the microphone has a larger cross-section than a remaining part of the elongated member extending therefrom towards the opposite end.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. A hearing aid, comprising:

a housing having an exterior surface and an opening at the exterior surface;

a battery door moveably coupled to the housing; and a spring element located in the housing, wherein the spring element is aligned with the opening of the housing to allow actuation of the spring element by a tool that is inserted through the opening of the housing;

wherein when the spring element is actuated by the tool, the battery door is allowed to be fully opened, and when the spring element is un-actuated, the battery door is prevented from being fully opened; and wherein the battery door comprises a wall part that (1) is raised with respect to an adjacent wall part of the housing, (2) forms a slot with the adjacent wall part of the housing, or (3) both raised with respect to the adjacent wall part of the housing and forms the slot with the adjacent wall part of the housing, for allowing an opening force be applied against the wall part by engagement of the wall part with a finger when the batter door is in a fully closed position.

2. The hearing aid of claim 1, further comprising a battery holder, wherein the battery door is a part of the battery holder.

3. The hearing aid of claim 1, wherein at least a part of the spring element is moveable relative to the housing in response to actuation by the tool.

4. The hearing aid of claim 1, wherein the spring element comprises a portion for abutment against a part of the housing to prevent the battery door from being fully opened when the battery door is moved to a partially-opened position.

5. The hearing aid of claim 4, wherein the portion of the spring element is configured to move relative to the housing to an actuated position in response to actuation of the spring element by the tool inserted through the opening of the housing, wherein when the portion of the spring element is at the actuated position, the portion of the spring element is out of abutment with the part of the housing, and the battery door is allowed to be moved to a fully-opened position.

6. The hearing aid of claim 4, wherein the spring element is coupled to the battery door and is moveable together with the battery door.

7. A hearing aid, comprising:

a housing having an exterior surface and an opening at the exterior surface;

a battery door moveably coupled to the housing; and a spring element located in the housing, wherein the spring element is aligned with the opening of the housing to allow actuation of the spring element by a tool that is inserted through the opening of the housing;

wherein when the spring element is actuated by the tool, the battery door is allowed to be fully opened, and when the spring element is un-actuated, the battery door is prevented from being fully opened;

wherein the spring element has a portion configured for engagement by the tool;

wherein the portion of the spring element is configured for abutment against a part of the housing to prevent the battery door from being fully opened when the battery door is moved to a partially-opened position; and wherein the portion of the spring element is spaced away from the part of the housing by a distance when the battery door is fully closed to allow the battery door to be partially opened before the spring element engages with the part of the housing.

8. The hearing aid of claim 1, wherein the spring element comprises a portion for abutment against a part of the housing to prevent the battery door from being partially opened.

9. The hearing aid of claim 8, wherein the portion of the spring element is configured to move relative to the housing to an actuated position in response to actuation of the spring element by the tool inserted through the opening of the housing, wherein when the portion of the spring element is at the actuated position, the portion of the spring is out of abutment with the part of the housing, and the battery door is allowed to be moved to an opened position.

10. The hearing aid of claim 8, wherein the spring element is coupled to the battery door and is moveable together with the battery door.

11. The hearing aid of claim 8, wherein the spring element is engaged with the part of the housing when the battery door is fully closed, to prevent the battery door from being partially opened.

12. The hearing aid of claim 1, wherein the spring element is moveably coupled to the housing.

13. The hearing aid of claim 12, wherein the battery door comprises an engagement portion.

14. The hearing aid of claim 13, wherein the spring element is configured to engage the engagement portion of the battery door to prevent the battery door from being fully opened.

15. The hearing aid of claim 14, wherein the spring element is spaced away from the engagement portion of the battery door when the battery door is fully closed relative to the housing, and wherein the battery door is moveable relative to the housing by a distance to a partially opened position, at which position, the spring element engages with the engagement portion of the battery door to prevent the battery door from being further moved relative to the housing.

16. A hearing aid, comprising:

a housing having an exterior surface and an opening at the exterior surface;

a battery door moveably coupled to the housing; and a spring element located in the housing, wherein the spring element is aligned with the opening of the housing to allow actuation of the spring element by a tool that is inserted through the opening of the housing;

wherein when the spring element is actuated by the tool, the battery door is allowed to be fully opened, and when the spring element is un-actuated, the battery door is prevented from being fully opened; and wherein the exterior surface with the opening is configured to be rear-facing with respect to a user of the hearing aid; and wherein the battery door comprises a wall part that (1) is raised with respect to an adjacent wall part of the housing, (2) forms a slot with the adjacent wall part of the housing, or (3) both raised with respect to the adjacent wall part of the housing and forms the slot with the adjacent wall part of the housing, when the batter door is in a fully closed position.

* * * * *